United States Patent [19]

Yamamoto

[11] 4,430,824

[45] Feb. 14, 1984

[54] COMPOSITE-PICTURE FORMING PLAY KIT

[76] Inventor: Shuzo Yamamoto, c/o Yasuyuki Yamamoto, 120 Ohaota, Kashiwashi, Chiba, Japan

[21] Appl. No.: 337,571

[22] Filed: Jan. 7, 1982

[51] Int. Cl.[3] ..... A63H 33/00

[52] U.S. Cl. ..... 46/16; 273/157 A

[58] Field of Search ..... 46/16, 17; 273/157 A, 273/241, 265

[56] References Cited

U.S. PATENT DOCUMENTS

| | | | |
|---|---|---|---|
| 2,280,609 | 4/1942 | Williamson | 273/157 A |
| 2,676,018 | 4/1954 | Cornish et al. | 273/241 |
| 3,107,918 | 10/1963 | Edlen | 273/157 A |
| 3,464,701 | 9/1969 | Mahoney | 273/241 |
| 3,510,134 | 5/1970 | Brooks et al. | 273/157 A X |
| 3,588,115 | 6/1971 | Nichols | 273/157 A X |
| 3,606,335 | 9/1971 | Reiner et al. | 273/241 |
| 3,879,040 | 4/1975 | Smith | 273/241 |
| 3,995,862 | 12/1976 | Bertin | 273/241 |
| 4,232,864 | 11/1980 | Yaworsky | 273/241 |

FOREIGN PATENT DOCUMENTS

| | | | |
|---|---|---|---|
| 2351623 | 4/1975 | Fed. Rep. of Germany | 273/157 A |
| 621701 | 4/1949 | United Kingdom | 273/157 A |

*Primary Examiner*—F. Barry Shay

*Attorney, Agent, or Firm*—Oldham, Oldham, Hudak, Weber & Sand Co.

[57] ABSTRACT

A kit for children's playing, fortune-telling, learning or the like use, including at least one pair of block pieces each carrying a figure thereon and at least one of which is of transparent material. The block pieces, of planar or cubic form, are laid one on the other to form a composite picture of the figures carried by the respective pieces, which is visible viewed from the transparent block side and changeable by changing the relative angular position of the block pieces. The cubic block pieces can each have three different figures respectively applied to its three faces forming a vertex so that the number of composite pictures obtainable therewith is multiplied. The wide variety of composite pictures obtainable with the play kit of the invention makes it highly attractive to children and also to grown-up people, despite of its extremely simple construction.

4 Claims, 21 Drawing Figures

COMPOSITE-PICTURE FORMING PLAY KIT

BACKGROUND AND SUMMARY OF THE INVENTION

This invention relates to composite-picture forming play kits or devices that enables the player to compose a variety of pictures simply by laying a plurality of picture elements or figures one on another in different ways and is usable for children's playing, fortune-telling, learning and the like purposes.

The present invention is intended to provide a novel form of play kit of the kind concerned which is characterized in that it comprises a pair of block pieces at least one of which is formed of an optically transparent material, the two block pieces carrying thereon respective figures, such as letters, symbols or patterns. The block pieces are designed to be laid on and in registry with each other to form a composite picture of the figures carried by the respective block pieces which is visible viewed from the transparent block piece side. Such composite picture is changeable by changing the angular position of the block pieces relative to each other.

The above and other objects, features and advantages of the present invention will become apparent from the following description when taken in conjunction with the accompanying drawings, which illustrate a few preferred embodiments of the invention.

DESCRIPTION OF THE PREFERRED EMBODIMENTS

Figure 1:
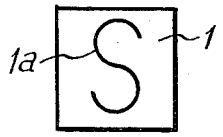
FIG. 1 is a plan view of one of the two planar block pieces of a composite-picture forming play kit embodying the present invention.
Figure 2:
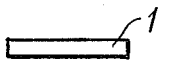
FIG. 2 is a front elevational view of same.
Figure 3:
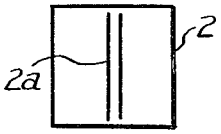
FIG. 3 is a view similar to FIG. 1, showing the other planar block piece of the play kit.
Figure 4:
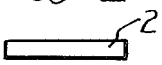
FIG. 4 is a view similar to FIG. 2, of the block piece shown in FIG. 3.
Figure 5A:
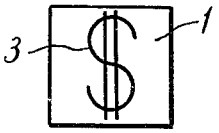
FIGS. 5A, 5B, 5C and 5C are plan views of the first embodiment, showing different composite pictures obtainable therewith.
Figure 5B:
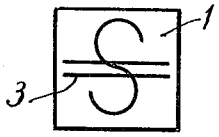
Figure 5C:
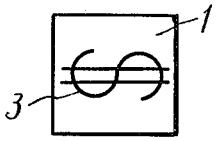
Figure 5D:
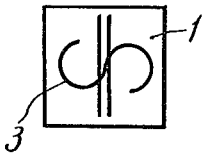
Figure 6:
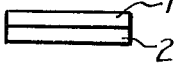
FIG. 6 is a front elevational view of the first embodiment in a state of use with its two block pieces laid on each other together to form a composite picture.

Referring to FIGS. 1 to 4, the first embodiment of the present invention comprises a pair of two planar or plate-like block pieces 1 and 2, both square-shaped, and at least one of which is formed of an optically transparent material. These block pieces 1, 2 carry thereon respective FIGS. 1*a* and 2*a*, such as letters, symbols or patterns, which are each applied to the planar region of the block piece, as shown. In use of the play kit, the two block pieces 1 and 2 are laid on and in registry with each other, as shown in FIG. 6 so that the FIGS. 1*a* and 2*a* are combined to form a composite picture 3 which is visible viewed from the transparent block piece (1) side since the FIG. 2*a* on the second block piece 2 can be clearly seen through the first block piece (1), which is transparent. In this instance, the composite picture 3 obtained here is one of four possible combinations of the two FIGS. 1*a* and 2*a*, which give four respective composite pictures each of which is identical with another but of different orientation therefrom, as will be described below. The FIGS. 1*a* and 2*a* can be formed on the block pieces 1 and 2 in any desired manner. For example, they can be drawn on the surface of the block pieces with paint or the like coating material; or, in the case of a transparent block piece or pieces, the figures can be formed by embedding therein. The planar block piece of opaque material may have two different figures applied to its opposing surfaces, if desired. In the first embodiment, the FIGS. 1*a* and 2*a* formed on the block pieces 1 and 2 represent "S" and "II", respectively, as seen in FIGS. 1 and 3, and in use four apparently different composite pictures 3 are obtainable by laying the first block piece 1 on and in registry with the second block piece 2 in different orientations, as shown in FIGS. 5A, 5B, 5C and 5D. Of the four composite pictures 3, the two shown in FIGS. 5A and 5C both represent a dollar mark "$" while the remaining two shown in FIGS. 5B and 5D do not represent any correct dollar mark. Such variety of composite pictures is utilized in use of the play kit of the present invention for playing, fortune-telling, learning or the like purpose. It will readily be noted that the relative angular position between the block pieces 1, 2, when laid on each other, is selectable by the player consciously or unconsciously.

Figure 7:
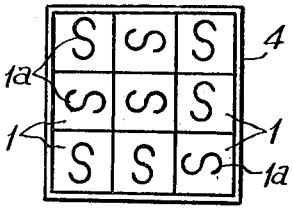
FIG. 7 is a plan view of one half of a second embodiment of the present invention which includes a first set of planar block pieces and a first case provided therefor.
Figure 8:
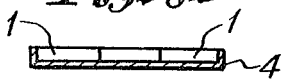
FIG. 8 is a front elevation in section of same.
Figure 9:
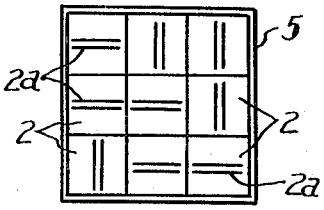
FIG. 9 is a view similar to FIG. 7, showing the other half of the second embodiment which includes a second set of planar block pieces and a second case provided therefor.
Figure 10:
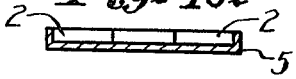
FIG. 10 is a view similar to FIG. 8 of same.
Figure 11:
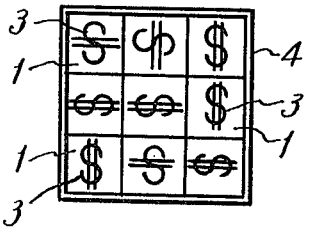
FIG. 11 is a plan view of the second embodiment, illustrating a set of composite pictures obtainable therewith.
Figure 12:
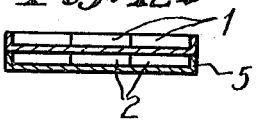
FIG. 12 is a front elevation in section of the second embodiment as shown in FIG. 11.

FIGS. 7 to 11 illustrate a second embodiment of the present invention which includes a first set of nine planar block pieces 1, of transparent material, and a second set of nine planar block pieces 2 or, in other words, includes nine pairs of planar block pieces 1 and 2. The first set of planar block pieces 1 are accommodated in a first open-top case 4 in a regular two-dimensional array, as shown in FIGS. 7 and 8. The case 4 is formed of an optically transparent material or formed in the bottom wall thereof with a multiplicity of through openings properly sized relative to the block pieces. The second set of planar block pieces 2 are accommodated in a second open-top case 5 of opaque material in the same regular two-dimension array, as shown in FIGS. 9 and 10. In either of the cases 4 and 5, the block pieces 1 or 2 can be arranged in any order and in any angular position relative to each other and to the case. If desired, the two cases 4 and 5 may both be partitioned into compartments each sized to accommodate one of the block pieces 1 or 2. As illustrated, the block pieces 1 in the first set and those 2 in the second set have applied thereto respective FIGS. 1*a* and 2*a* which are the same as those employed in the first embodiment. Accordingly, when the first case 4 is laid on and in registry with the second case 5, as shown in FIG. 12, with the first and second sets of block pieces 1 and 2 orderly accommodated in the respective cases 4 and 5, there are formed a set of nine composite pictures 3, as illustrated in FIG. 11, which are visible viewed from above, i.e., from the transparent block piece (1) side and each changeable by changing the angular position of the paired block pieces 1 and 2 relative to each other, thus rendering the play kit highly attractive to the player.

Though, in the second embodiment, the first and second cases 4 and 5 are each designed to accommodate a set of nine planar block pieces 1 or 2, it will be readily noted that the embodiment may be modified, if desired, to increase or decrease the number of block pieces to be accommodated in each of the two cases 4 and 5 and hence the number of composite pictures 3 simultaneously obtainable with the play kit. Further, in order to ensure that the cases 4 and 5 be held in exact registry at all times when laid on each other, any appropriate interfitting means and/or magnet means may be provided thereon. In a further modification, the lower, second case 5 is formed directly on its inside bottom surface with a set of FIGS. 2*a* in lieu of the second set of planar block pieces 2 to be accommodated therein. This makes it possible to omit the first case 4 as well as the block pieces 2.

Figure 13:
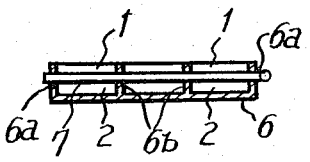
FIG. 13 is a front elevation in section of a third embodiment of the present invention.

FIG. 13 illustrates a third embodiment of the present invention which includes a single open-top case 6 having a depth about two times as large as that of cases 4 and 5 of the second embodiment and a removable partitioning plate 7 slidingly insertable into the case 6 from one side thereof to divide the case into two, upper and lower compartments, as shown. Two sets of planar block pieces 1 and 2, similar to those employed in the second embodiment, are accommodated in the single case 6 separately above and below the partitioning plate 7. The partitioning plate 7, formed of an opaque material, is insertable into the case 6 through either of two aligned horizontally extending slots 6*a* formed in the opposing side walls of the case to guide and support the partitioning plate during and after insertion. In this embodiment, the upper and lower sets of planar block pieces 1 and 2 as accommodated in the case 6 are combined with each other to form a set of composite pictures only when the partitioning plate 7 is removed out of the case 6 and this adds much to the player's interests. Also in FIG. 13, reference numeral 6*b* indicates partitions formed in the case 6 to divide it into a set of compartments each sized to accommodate one pair of block pieces 1 and 2. Incidentally, a removable partitioning plate of opaque material similar to the one 7 employed in this third embodiment may be provided also in the second embodiment in the bottom of first case 4 or in the top of second case 5. To do this, however, the height of the peripheral wall of the case 4 or 5 should be increased by an amount substantially equal to the thickness of the partitioning plate.

Figure 14:
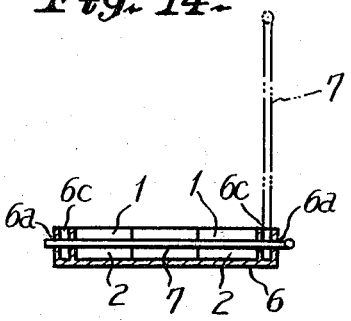
FIG. 14 is a view similar to FIG. 13 of a fourth embodiment of the present invention.

FIG. 14 illustrates a fourth embodiment which, like the third one, includes a single case and a removable partitioning plate 7. Only in this embodiment, the case 6 is formed in its two opposing side walls with an upwardly opening groove 6*c*, of substantial depth, sized to fittingly receive one end portion of the partitioning plate 7 thereby to hold the latter in an upright position. The purpose of this arrangement is to enable use of the partitioning plate 7 not only as such but also as a concealing screen that enables the player to hide the lower array of block pieces 2 arranged in the case as from a playfellow or fellows in company.

Figure 15:
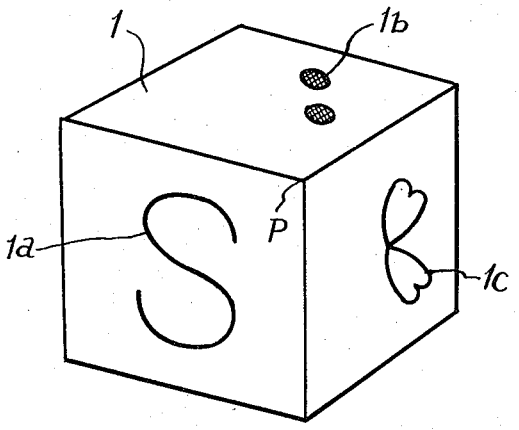
FIG. 15 is an oblique view of one of the two cubic block pieces of a fifth embodiment of the present invention.
Figure 17A:
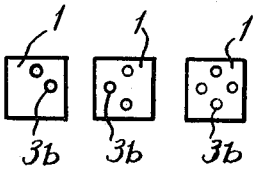
FIGS. 17A and 17B are plan views, on a reduced scale, of the fifth embodiment, illustrating some of the different composite pictures obtainable therewith.
Figure 17B:
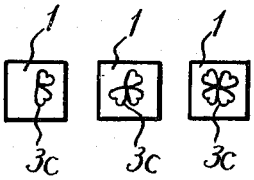
Figure 16:
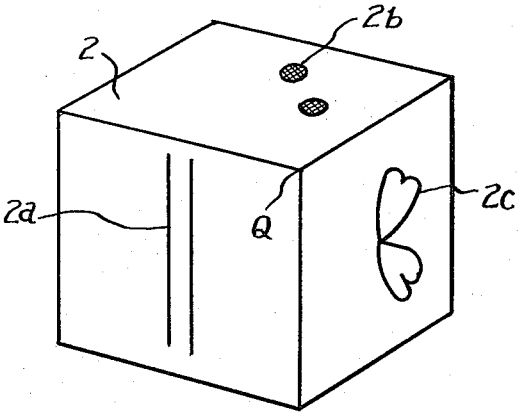
FIG. 16 is a view similar to FIG. 15, showing the other cubic block piece of the fifth embodiment.

FIGS. 15 and 16 illustrate a fifth embodiment of the present invention which includes a pair of block pieces 1 and 2 both of cubic form. As shown, each of the block pieces has a set of three different FIGS. 1*a*, 1*b*, 1*c*; or 2*a*, 2*b*, 2*c* applied to its three adjacent faces that form a vertex P or Q. As in the embodiments previously shown and described, at least one of the paired block pieces 1 and 2 is formed of an optically transparent material; and, in use, the three FIGS. 1*a*, 1*b* and 1*c* on the block piece 1 are to be combined respectively with the FIGS. 2*a*, 2*b* and 2*c* on the block piece 2. A pair of FIGS. 1*a* and 2*a*, when combined, form a composite picture 3 like the one shown in either FIGS. 5A or 5B; another pair of FIGS. 1*b* and 2*b* are capable of forming three composite pictures 3*b* illustrated in FIG. 17A; and a third pair of FIGS. 1*c* and 2*c* three composite pictures 3*c* illustrated in FIG. 17B. Such wide variety of composite pictures obtainable with this embodiment makes the range of use of the embodiment for playing, fortune-telling, learning or the like purpose correspondingly wide and add much zest to the embodiment.

It will be apparent to those skilled in the art that, though the block pieces 1 and 2 illustrated herein are of the form of a flat square plate or a solid cube, they may be formed otherwise, for example, as a circular or polygonal disc. It will be obvious that the block pieces 1 and 2 may both be formed of a transparent material, if desired. Further, though in the embodiments shown and described herein the block pieces are laid in two layers, it will be apparent that the play kit of the present invention may also be arranged so that the block pieces be laid in three or more layers, if desired, and such design is within the contemplation of the present invention.

To summarize, the composite-picture forming play kit of the present invention includes a pair or pairs of block pieces 1 and 2 carrying thereon FIGS. 1*a* and 2*a*, such as letters, symbols or patterns, and is capable of forming a number of different composite pictures of the FIGS. 1*a* and 2*a* by laying the block pieces on each other in different angular positions relative to each other. Accordingly, despite of its extremely simple construction, the kit is usable with great interest not only by children but also by grown-up people for playing, fortune-telling, learning and the like purposes.

What is claimed is:

1. A composite-picture forming play kit of the type including a first set of block pieces formed of an optically transparent material and a second set of block pieces; said block pieces in each of the first and second sets of block pieces carrying thereon respective figures such as letters, symbols or the like pattern; an open-top case adapted to accommodate the first and second sets of block pieces both in a regular two-dimensional array in such a manner that each of the block pieces in the first set lies within said case on and in registry with one of the block pieces in the second set so that a set of composite pictures are formed by the figures carried by said pair of block pieces overlying on each other, with said composite picture being visible as viewed from the first block piece set side and each changeable by changing the angular position of said two block pieces relative to each other; and a partitioning plate of opaque material slidingly insertable into the case from one side thereof to separate the first set of block pieces from the second set of block pieces, wherein the case is formed in at least one of two opposing side walls thereof with a horizontally extending guide slot to guidingly receive said partitioning plate.

2. A play kit as claimed in claim 1, characterized in that the case is formed in at least one side wall thereof with an upwardly opening groove sized to fittingly receive one end portion of the partitioning plate thereby to hold the latter in an upright posture to serve as a concealing screen.

3. A play kit as claimed in claims 1 and 2, characterized in that the block pieces are of cubic form.

4. A play kit as claimed in claim 3, characterized in that each of said block pieces has three faces forming a vertex, in which a figure is carried on each of said three faces; and in which each of said figures of one block piece is combined with one of the three figures carried by the other of said block pieces.

* * * * *